US011280288B2

(12) United States Patent
Tsuji et al.

(10) Patent No.: US 11,280,288 B2
(45) Date of Patent: Mar. 22, 2022

(54) ANOMALY DIAGNOSTIC DEVICE FOR ONBOARD INTERNAL COMBUSTION ENGINE

(71) Applicant: TOYOTA JIDOSHA KABUSHIKI KAISHA, Toyota (JP)

(72) Inventors: Tomoyuki Tsuji, Nagakute (JP); Naoya Okubo, Chiryu (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 49 days.

(21) Appl. No.: 16/850,514

(22) Filed: Apr. 16, 2020

(65) Prior Publication Data

US 2020/0362787 A1 Nov. 19, 2020

(30) Foreign Application Priority Data

May 16, 2019 (JP) ..... JP2019-093061

(51) Int. Cl.
*F01M 13/00* (2006.01)
*F02D 41/22* (2006.01)

(52) U.S. Cl.
CPC ..... *F02D 41/222* (2013.01); *F01M 13/00* (2013.01); *F02D 41/22* (2013.01); *F01M 2013/0083* (2013.01); *F02D 2041/223* (2013.01); *F02D 2250/08* (2013.01)

(58) Field of Classification Search
CPC ..... F01M 13/00; F01M 2013/0083; F02D 41/22; F02D 2250/08
USPC ..... 73/114.31, 114.33, 114.37; 123/572–574
See application file for complete search history.

(56) References Cited

U.S. PATENT DOCUMENTS

| | | | | |
|---|---|---|---|---|
| 9,127,578 | B2 * | 9/2015 | Pursifull | F01M 13/00 |
| 9,382,823 | B2 * | 7/2016 | Rollinger | F02D 41/0025 |
| 9,664,079 | B2 * | 5/2017 | Jentz | F01M 11/10 |
| 10,043,352 | B2 * | 8/2018 | Henson | F01M 13/022 |
| 10,808,658 | B2 * | 10/2020 | Sekiguchi | F02M 35/1038 |
| 10,871,129 | B1 * | 12/2020 | Jentz | F01M 1/20 |
| 10,982,574 | B2 * | 4/2021 | Hofmann | F02M 35/1038 |

(Continued)

FOREIGN PATENT DOCUMENTS

| | | |
|---|---|---|
| JP | 3-172524 A | 7/1991 |
| JP | 2013-117176 A | 6/2013 |

(Continued)

*Primary Examiner* — Erick R Solis
(74) *Attorney, Agent, or Firm* — Oblon, McClelland, Maier & Neustadt, L.L.P.

(57) ABSTRACT

An anomaly diagnostic device for an onboard internal combustion engine includes a parameter deriving unit and a leaking anomaly diagnostic unit. The parameter deriving unit is configured to derive a determination parameter such that, when a PCV pressure sensor value that indicates a pressure detected by a PCV pressure sensor is less than an atmospheric pressure, a value of the determination parameter increases as the difference between the PCV pressure sensor value and the atmospheric pressure increases. The leaking anomaly diagnostic unit is configured to perform a leaking anomaly diagnostic process that diagnoses that there is an anomaly at a portion of a blow-by gas passage that is closer to an intake passage than to a connection portion of the PCV pressure sensor when the determination parameter derived when an intake air amount changes is less than a threshold.

7 Claims, 7 Drawing Sheets

(56) References Cited

U.S. PATENT DOCUMENTS

| | | | | |
|---|---|---|---|---|
| 11,053,878 | B2 * | 7/2021 | Sekiguchi | F02D 41/18 |
| 2014/0081551 | A1 * | 3/2014 | Rollinger | F01M 13/023 701/101 |
| 2015/0114326 | A1 * | 4/2015 | Burkhardt | F01M 13/023 123/41.86 |
| 2016/0097355 | A1 | 4/2016 | Jentz et al. | |
| 2017/0175662 | A1 | 6/2017 | Yoshioka et al. | |
| 2018/0371971 | A1 | 12/2018 | Nakano et al. | |
| 2019/0234261 | A1 | 8/2019 | Ishikawa et al. | |

FOREIGN PATENT DOCUMENTS

| | | | |
|---|---|---|---|
| JP | 2017-115584 | A | 6/2017 |
| JP | 2017-115849 | A | 6/2017 |
| JP | 2019-132232 | A | 8/2019 |

* cited by examiner

ANOMALY DIAGNOSTIC DEVICE FOR ONBOARD INTERNAL COMBUSTION ENGINE

BACKGROUND

1. Field

The following description relates to an anomaly diagnostic device for an onboard internal combustion engine that is applied to an internal combustion engine configured to return blow-by gas, which is leaked into a crankcase from a combustion chamber, to an intake passage.

2. Description of Related Art

Japanese Laid-Open Patent Publication No. 3-172524 describes an example of an internal combustion engine including a blow-by gas passage. The blow-by gas passage of the internal combustion engine has one end that is connected to the head cover and another end that is connected to the intake passage. The internal combustion engine includes a PCV pressure sensor that detects the pressure of the space defined by the head cover and the cylinder head. The space temporarily stores blow-by gas leaked into the crankcase from the combustion chamber.

If the blow-by gas passage is disconnected from the intake passage or if the blow-by gas passage is broken, blow-by gas may leak out. Accordingly, in recent years, there is a need to detect that the blow-by gas passage has been disconnected from the intake passage or the blow-by gas passage has been broken.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, an anomaly diagnostic device is provided. The anomaly diagnostic device is configured to diagnose the onboard internal combustion engine. The onboard internal combustion engine includes a forced-induction device, a storage portion that stores blow-by gas leaked into a crankcase from a combustion chamber, a blow-by gas passage that connects the storage portion and a portion of an intake passage that is upstream of a compressor of the forced-induction device, and a PCV pressure sensor that is connected to the blow-by gas passage and detects a pressure in the blow-by gas passage. The anomaly diagnostic device includes a parameter deriving unit that is configured to derive a determination parameter such that, when a PCV pressure sensor value that indicates a pressure detected by the PCV pressure sensor is less than an atmospheric pressure, a value of the determination parameter increases as a difference between the PCV pressure sensor value and the atmospheric pressure increases, and a leaking anomaly diagnostic unit that is configured to perform a leaking anomaly diagnostic process that diagnoses that there is an anomaly at a portion of the blow-by gas passage that is closer to the intake passage than to a connection portion of the PCV pressure sensor when the determination parameter derived, when an intake air amount changes, is less than a threshold.

A state in which an anomaly is not generated in the blow-by gas passage is referred to as a normal state. When the blow-by gas passage is in the normal state, while intake air is pressurized through driving of the forced-induction device, a negative pressure is generated in the portion of the intake passage that is upstream of the compressor. Accordingly, blow-by gas in the blow-by gas passage flows into the intake passage. In other words, the blow-by gas is returned from the blow-by gas passage to the intake passage. This causes the pressure in the blow-by gas passage to become less than the atmospheric pressure. When intake air amount changes, the pressure at the portion of the intake passage that is upstream of the compressor changes, so that the pressure in the blow-by gas passage is changed. In this case, the amount of change in the pressure in the blow-by gas passage increases as the amount of change in the pressure at the portion of the intake passage that is upstream of the compressor increases.

When the blow-by gas passage is disconnected from the intake passage, or when the portion of the blow-by gas passage that is closer to the intake passage than to the connection portion, which is referred to as the gas passage portion toward the intake passage, is broken, the blow-by gas passage is connected to the atmosphere. In other words, when the blow-by gas passage is disconnected from the intake passage, even if a negative pressure is generated in the portion of the intake passage that is upstream of the compressor, the pressure in the blow-by gas passage is maintained at a value that is close to the atmospheric pressure. Further, when the gas passage portion toward the intake passage is broken, the space inside the blow-by gas passage is connected to the atmosphere through the broken part. Accordingly, even when the intake air amount changes, the PCV pressure sensor value is less likely to be changed.

With the above structure, the determination parameter is derived based on the PCV pressure sensor value. If the PCV pressure sensor value is less than the atmospheric pressure, a value of the determination parameter increases as the difference between the PCV pressure sensor value and the atmospheric pressure increases. In other words, even when the intake air amount is increasing, the determination parameter does not increase as long as the PCV pressure sensor value is not changed greatly. In the same manner, even when the intake air amount is decreasing, the determination parameter does not increase as long as the PCV pressure sensor value is not changed greatly. Accordingly, when the blow-by gas passage is disconnected from the intake passage, or when the gas passage portion toward the intake passage is broken, the determination parameter derived when the intake air amount changes does not increase as compared with the case where the blow-by gas passage is in the normal state. This allows for diagnosis that there is an anomaly at the gas passage portion toward the intake passage when the determination parameter is less than the threshold.

Thus, the above structure detects that the blow-by gas passage is disconnected from the intake passage and the blow-by gas passage is broken.

When the blow-by gas passage is disconnected from the intake passage, or when the gas passage portion toward the intake passage is broken, blow-by gas may leak out. Such an anomaly in which blow-by gas may leak out is referred to as the leaking anomaly.

In the case where the blow-by gas passage is in the normal state, when intake air is increasing, an amount of increase in a negative pressure generated in the portion of the intake passage that is upstream of the compressor increases as a monitoring period of the pressure in the blow-by gas passage is prolonged. This decreases the PCV pressure sensor value accordingly. In the same manner, when intake air is decreasing, an amount of decrease in a negative pressure generated in the portion of the intake passage that is upstream of the compressor increases as the monitoring period is prolonged. This increases the PCV pressure sensor value accordingly. However, the PCV pressure sensor has temperature characteristics. When the temperature of the PCV pressure sensor changes, the PCV pressure sensor value is changed in accordance with the temperature characteristics of the PCV pressure sensor. When the monitoring period is long, the amount of change in temperature of the PCV pressure sensor is likely to increase during the monitoring period. Accordingly, the temperature characteristics of the PCV pressure sensor are likely to affect the determination parameter as the monitoring period is prolonged.

In another general aspect, the anomaly diagnostic device for an onboard internal combustion engine further includes a change-associated value deriving unit that is configured to derive a change-associated value corresponding to an amount of change in the PCV pressure sensor value in a predetermined monitoring period. In the anomaly diagnostic device, the parameter deriving unit is configured to derive an integrated value of a plurality of change-associated values as the determination parameter.

With the above structure, a value corresponding to the amount of the change in the PCV pressure sensor value in the monitoring period is derived as the change-associated value, and an integrated value of a plurality of change-associated values is derived as the determination parameter. In other words, the period in which the determination parameter is derived is divided into plural number of times. This prevents a single monitoring period from being prolonged. As a result, the temperature characteristics of the PCV pressure sensor are less likely to affect change-associated value.

When the difference between the PCV pressure sensor value at the starting point of monitoring periods and the PCV pressure sensor value at the end point of the monitoring periods is derived as a value associated with the amount of change, when a single monitoring period is short, the value associated with the amount of change is less likely to increase even in the case where the blow-by gas passage is in the normal state. Even if plural change-associated values derived in this manner are integrated to obtain the determination parameter, the determination parameter is less likely to have a large difference between when the blow-by gas passage is in the normal state and when there is a leaking anomaly.

In this respect, the change-associated value deriving unit may be configured to set a reference value to the PCV pressure sensor value at a starting point of the monitoring period when the intake air amount is increasing, and the change-associated value deriving unit may also be configured to derive an integrated value of differences between a plurality of PCV pressure sensor values and the reference value in the monitoring period as the change-associated value. The parameter deriving unit may be configured to derive the determination parameter by integrating the change-associated values derived based on a change in the PCV pressure sensor value in the monitoring period when an amount of increase in the intake air amount in the monitoring period is greater than or equal to an amount of change for determination. Thus, the determination parameter has a large difference between when the blow-by gas passage is in the normal state and when there is a leaking anomaly.

The change-associated value deriving unit may also be configured to obtain a plurality of PCV pressure sensor values in the monitoring period when the intake air amount increases or decreases, set a reference value to a maximum value among the plurality of PCV pressure sensor values obtained in the monitoring period, and derive, as the change-associated value, an integrated value of differences between the plurality of PCV pressure sensor values obtained in the monitoring period and the reference value. In this case, the determination parameter has a large difference between when the blow-by gas passage is in the normal state and when there is a leaking anomaly.

With the above structure, the change-associated value is derived in both of a case where a negative pressure increases in the portion of the intake passage that is upstream of the compressor because of an increased intake air amount and a case where a negative pressure decreases in the portion of the intake passage that is upstream of the compressor because of a decreased intake air amount. This increases opportunities to derive the change-associated value than a case where the change-associated value is derived only when the intake air amount is increased.

Anomalies occurring in the blow-by gas passage include a leaking anomaly and clogging. If clogging occurs in the blow-by gas passage, blow-by gas generated in the internal combustion engine cannot be returned to the intake passage through the blow-by gas passage. During engine operation, the internal combustion engine continues generating blow-by gas. Accordingly, when clogging occurs in the blow-by gas passage, the pressure in the storage portion and the pressure in the blow-by gas passage become high. That is, the PCV pressure sensor value is increased.

In another general aspect, the anomaly diagnostic device for an onboard internal combustion engine includes an increase determination unit that is configured to determine, based on the PCV pressure sensor value, whether the pressure in the blow-by gas passage will increase when the intake air amount is increased, and a clogging anomaly diagnostic unit that is configured to diagnose that there is clogging in the gas passage portion toward the intake passage when the increase determination unit determines that the pressure in the blow-by gas passage will increase when the intake air amount is increased under a situation where intake air is changed. This structure diagnoses that there is clogging in the gas passage portion toward the intake passage when the increase determination unit determines that the pressure in the blow-by gas passage will increase when the intake air amount is increased under a situation where a negative pressure is generated in the portion of the intake passage that is upstream of the compressor.

The leaking anomaly diagnostic unit may perform the leaking anomaly diagnostic process on condition that the clogging anomaly diagnostic unit has not diagnosed that there is clogging in the gas passage portion toward the intake passage. In this case, the leaking anomaly diagnostic process is not performed when there is clogging in the gas passage portion toward the intake passage. This reduces diagnosis of a leaking anomaly when there is a clogging anomaly at the gas passage portion toward the intake passage.

In another general aspect, in the anomaly diagnostic device for an onboard internal combustion engine, the blow-by gas passage includes a joint connected to the storage portion and a blow-by gas pipe that includes an end connected to the joint and another end connected to the intake passage, and the PCV pressure sensor is connected to the joint. With the above structure, a leaking anomaly is detected when the blow-by gas pipe is disconnected from the intake passage, when the blow-by gas pipe is disconnected from the joint, or when the blow-by gas pipe is broken.

In another general aspect, an anomaly diagnostic device is provided. An anomaly diagnostic device is configured to diagnose the onboard internal combustion engine. The onboard internal combustion engine includes a forced-induction device, a storage portion that stores blow-by gas leaked into a crankcase from a combustion chamber, a blow-by gas passage that connects the storage portion and a portion of an intake passage that is upstream of a compressor of the forced-induction device, and a PCV pressure sensor that is connected to the blow-by gas passage and detects a pressure in the blow-by gas passage. The anomaly diagnostic device includes processing circuitry. The processing circuitry is configured to derive a determination parameter such that, when a PCV pressure sensor value that indicates a pressure detected by the PCV pressure sensor is less than an atmospheric pressure, a value of the determination parameter increases as a difference between the PCV pressure sensor value and the atmospheric pressure increases. The processing circuitry is also configured to perform a leaking anomaly diagnostic process that diagnoses that there is an anomaly at a portion of the blow-by gas passage that is closer to the intake passage than to a connection portion of the PCV pressure sensor when the determination parameter derived when an intake air amount changes is less than a threshold.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

First Embodiment

An anomaly diagnostic device 50 for an onboard internal combustion engine according to a first embodiment will now be described with reference to FIGS. 1 to 8.

Figure 1:
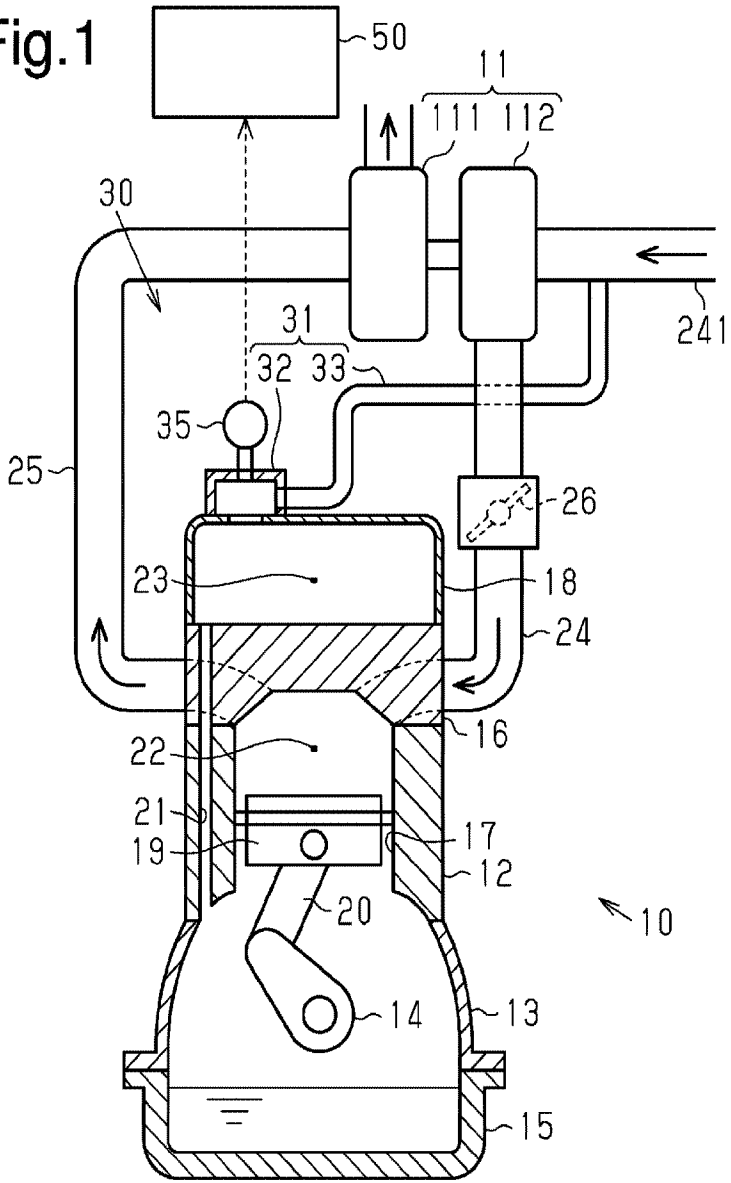
FIG. 1 is a diagram schematically showing an internal combustion engine including an anomaly diagnostic device according to a first embodiment.

FIG. 1 shows an internal combustion engine 10 that includes the anomaly diagnostic device 50 according to the present embodiment. The anomaly diagnostic device 50 is an electronic control unit that includes a processing circuit. The internal combustion engine 10 is an onboard internal combustion engine including an exhaust-driven forced-induction device 11. The internal combustion engine 10 includes a cylinder block 12 having a lower portion to which a crankcase 13 is attached. The crankcase 13 accommodates a crankshaft 14. The crankcase 13 has a lower portion to which an oil pan 15 is attached. The oil pan 15 stores oil circulating in the internal combustion engine 10.

The cylinder block 12 has an upper portion to which a cylinder head 16 is attached. The cylinder block 12 and the cylinder head 16 define cylinders 17. FIG. 1 shows only one cylinder 17. The cylinder head 16 has an upper portion to which a head cover 18 is attached.

The cylinders 17 each accommodate a piston 19. Each piston 19 is coupled to the crankshaft 14 via a connecting rod 20. The pistons 19 reciprocate inside the cylinders 17, causing the crankshaft 14 to rotate.

The internal combustion engine 10 includes a connection passage 21 that connects the space defined by the cylinder head 16 and the head cover 18 to the space inside the crankcase 13. The connection passage 21 extends over the cylinder block 12 and the cylinder head 16. Accordingly, blow-by gas leaked into the crankcase 13 from a combustion chamber 22 defined inside the cylinder 17 flows through the connection passage 21 into the space defined by the cylinder head 16 and the head cover 18. The space corresponds to a storage portion 23 that stores blow-by gas.

The cylinder head 16 is connected to an intake passage 24 and an exhaust passage 25. Intake air that has flowed through the intake passage 24 is drawn into the combustion chamber 22. In the combustion chamber 22, air-fuel mixture containing intake air and fuel is burned. Exhaust gas generated by the combustion of the air-fuel mixture in the combustion chamber 22 is discharged into the exhaust passage 25. The exhaust passage 25 includes a turbine 111 of the forced-induction device 11. The intake passage 24 includes a compressor 112 of the forced-induction device 11 at a location that is upstream of a throttle valve 26.

The internal combustion engine 10 includes a blow-by gas processing device 30 that returns blow-by gas that is stored in the storage portion 23 to the intake passage 24. A portion of the intake passage 24 that is upstream of the compressor 112 is referred to as an upstream intake passage 241. The blow-by gas processing device 30 includes a blow-by gas passage 31 that connects the storage portion 23 and the upstream intake passage 241 and a PCV pressure sensor 35 that detects the pressure in the blow-by gas passage 31. The PCV pressure sensor 35 is a sensor that detects the absolute pressure in the blow-by gas passage 31 as a PCV pressure sensor value PCVS and outputs a signal corresponding to the PCV pressure sensor value PCVS as a detection signal to the anomaly diagnostic device 50. The blow-by gas passage 31 includes a joint 32 attached to the head cover 18 and a blow-by gas pipe 33 having one end that is connected to the joint 32 and another end that is connected to the upstream intake passage 241. The PCV pressure sensor 35 is connected to the joint 32. That is, the PCV pressure sensor value PCVS detected by the PCV pressure sensor 35 indicates the absolute pressure in the joint 32.

The anomaly diagnostic device 50 will now be described with reference to FIGS. 2 and 3.

Figure 2:
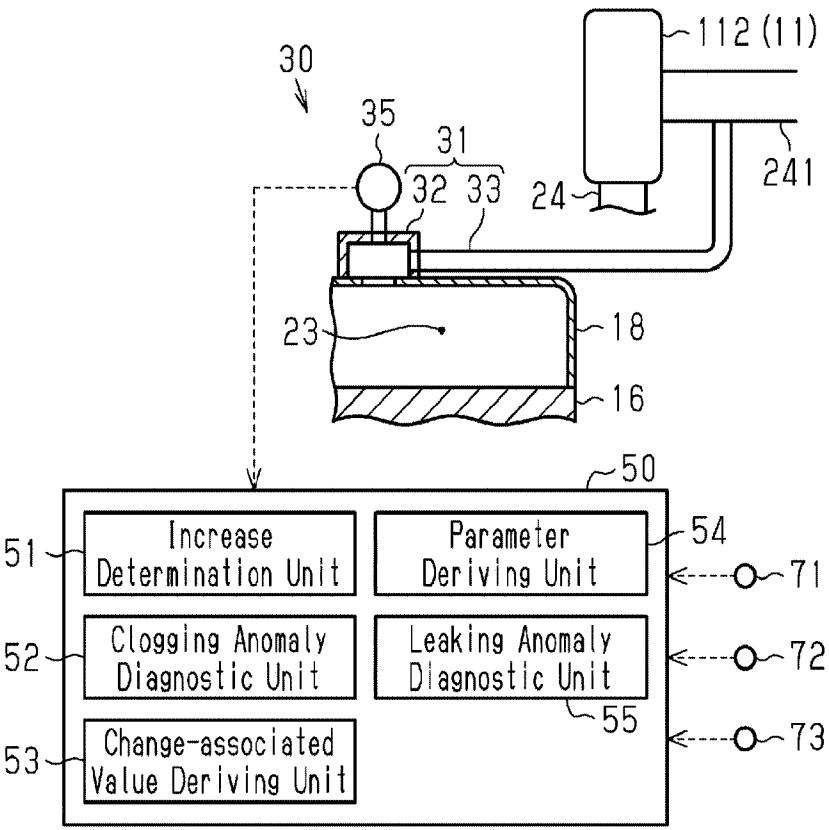
FIG. 2 is a block diagram showing the functional configuration of the anomaly diagnostic device.

As shown in FIG. 2, the anomaly diagnostic device 50 receives detection signals from the PCV pressure sensor 35, an atmospheric pressure sensor 71, an air flowmeter 72, and a battery voltage sensor 73. The atmospheric pressure sensor 71 detects an atmospheric pressure PHAC that indicates the pressure in the vicinity of the internal combustion engine 10 and outputs a signal corresponding to the atmospheric pressure PHAC as a detection signal. The air flowmeter 72 detects an intake air amount GA that indicates the amount of intake air flowing in the intake passage 24 and outputs a signal corresponding to the intake air amount GA as a detection signal. The battery voltage sensor 73 detects a battery voltage Vbt that indicates the voltage of an onboard battery and outputs a signal corresponding to the battery voltage Vbt as a detection signal.

The anomaly diagnostic device 50 is configured to diagnose whether there is an anomaly at the blow-by gas processing device 30. Anomalies diagnosed by the anomaly diagnostic device 50 include a clogging anomaly and a leaking anomaly. The clogging anomaly refers to clogging occurring at a portion of the blow-by gas passage 31 that is closer to the upstream intake passage 241 than to a connection portion of the PCV pressure sensor 35. When clogging occurs at the portion, blow-by gas stored in the storage portion 23 cannot flow into the intake passage 24 via the blow-by gas passage 31. The leaking anomaly refers to an anomaly in which blow-by gas may leak out of a portion of the blow-by gas passage 31 that is closer to the upstream intake passage 241 than to the connection portion of the PCV pressure sensor 35. The leaking anomaly occurs if the blow-by gas pipe 33 is disconnected from the intake passage 24, if the blow-by gas pipe 33 is disconnected from the joint 32, or if the blow-by gas pipe 33 is broken.

If the blow-by gas pipe 33 is disconnected from the intake passage 24, blow-by gas leaks out through the opening of the blow-by gas pipe 33 that was connected to the intake passage 24. If the blow-by gas pipe 33 is disconnected from the joint 32, blow-by gas leaks out from the joint 32. If the blow-by gas pipe 33 is broken, blow-by gas may leak out through the broken part. Further, when the pressure in the storage portion 23 is not very high when the blow-by gas pipe 33 is broken, the atmosphere may flow into the blow-by gas pipe 33 through the broken part.

The relationship between a joint internal pressure PFIT and the intake air amount GA will now be described with reference to FIG. 3. The joint internal pressure PFIT refers to the pressure in the joint 32.

Figure 3:
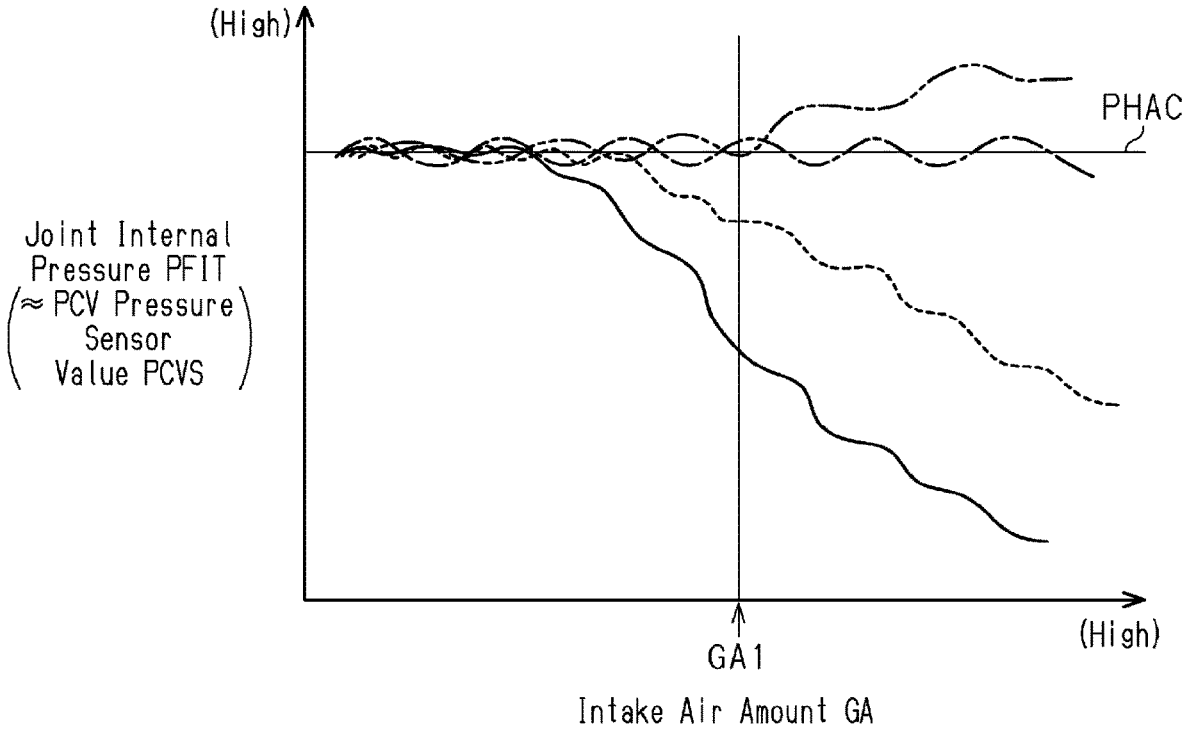
FIG. 3 is a graph showing the relationship between an intake air amount and a joint internal pressure.

The thick solid line in FIG. 3 shows the relationship between the joint internal pressure PFIT and the intake air amount GA when the blow-by gas passage 31 is in a normal state. The normal state refers to a state of the blow-by gas passage 31 in which neither a leaking anomaly nor a clogging anomaly has occurred. Blow-by gas in the storage portion 23 is returned to the intake passage 24 via the blow-by gas passage 31 without leaking out. Forced induction performed by the forced-induction device 11 generates a negative pressure in the upstream intake passage 241, so that blow-by gas in the blow-by gas passage 31 flows into the intake passage 24. As a result, the joint internal pressure PFIT becomes lower than the atmospheric pressure PHAC. The amount of such blow-by gas flowing into the intake passage 24 increases because the negative pressure in the upstream intake passage 241 increases as the intake air amount GA increases. That is, the joint internal pressure PFIT decreases as the intake air amount GA increases.

The long dashed double-short dashed line in FIG. 3 shows the relationship between the joint internal pressure PFIT and the intake air amount GA if a clogging anomaly occurs. Since the clogging anomaly blocks the connection made via the blow-by gas passage 31 between the storage portion 23 and the intake passage 24, blow-by gas of the storage portion 23 is not returned to the intake passage 24 via the blow-by gas passage 31. Further, during engine operation, the internal combustion engine 10 continues generating blow-by gas. The amount of generated blow-by gas increases as the intake air amount GA increases. Accordingly, unlike the normal state of the blow-by gas passage 31, the joint internal pressure PFIT does not decrease even if the intake air amount GA increases and a negative pressure is generated in the upstream intake passage 241. Specifically, the joint internal pressure PFIT becomes greater than the atmospheric pressure PHAC if the intake air amount GA is at a predetermined level or more.

The broken line and the long dashed short dashed line in FIG. 3 show the relationship between the joint internal pressure PFIT and the intake air amount GA if a leaking anomaly occurs. The relationship shown by the long dashed short dashed line indicates that the blow-by gas pipe 33 is disconnected from the intake passage 24 or the blow-by gas pipe 33 is disconnected from the joint 32. The relationship shown by the broken line indicates that the blow-by gas passage 31 is broken and blow-by gas leaks out through the broken part. If the blow-by gas pipe 33 is disconnected from the intake passage 24 or the blow-by gas pipe 33 is disconnected from the joint 32, the inside of the joint 32 will be open to the atmosphere. Accordingly, as shown by the long dashed short dashed line of FIG. 3, the joint internal pressure PFIT is maintained near the atmospheric pressure PHAC regardless of an increase in the intake air amount GA.

If the blow-by gas passage 31 is broken, a certain amount of blow-by gas may be returned to the intake passage 24 via the blow-by gas passage 31 depending on the area of the opening of the broken part. The joint internal pressure PFIT becomes lower than the atmospheric pressure PHAC accordingly. The amount of such blow-by gas flowing into the intake passage 24 increases because the negative pressure in the upstream intake passage 241 increases as the intake air amount GA increases. Accordingly, the joint internal pressure PFIT increases as the intake air amount GA increases. However, the inside of the blow-by gas passage 31 is connected to the atmosphere through the broken part, so that the joint internal pressure PFIT is closer to the atmospheric pressure PHAC from the normal state of the blow-by gas passage 31 as shown by the broken line in FIG. 3.

As shown in FIG. 2, the anomaly diagnostic device 50 includes an increase determination unit 51, a clogging anomaly diagnostic unit 52, a change-associated value deriving unit 53, a parameter deriving unit 54, and a leaking anomaly diagnostic unit 55 in order to diagnose whether there is an anomaly at the blow-by gas processing device 30.

The increase determination unit 51 is configured to determine, based on the PCV pressure sensor value PCVS, whether the pressure in the blow-by gas passage 31 will increase when the intake air amount GA increases. The process of the determination will be described later.

The clogging anomaly diagnostic unit 52 is configured to diagnose that there is a clogging anomaly if the increase determination unit 51 determines that the pressure in the blow-by gas passage 31 will increase when the intake air amount GA increases under a situation where forced induction is performed by the forced-induction device 11.

The change-associated value deriving unit 53 derives, as a change-associated value X, a value corresponding to the amount of the change in the PCV pressure sensor value PCVS in a predetermined monitoring period PRD. A process of deriving the change-associated value X will be described later.

The PCV pressure sensor 35 has temperature characteristics. When a vehicle is traveling through engine operation, the atmospheric pressure PHAC may change in the monitoring period PRD. The length of the monitoring period PRD is set so that when the change-associated value X is derived, the effect of the temperature characteristics and the effect of the change in the atmospheric pressure PHAC on the change-associated value X will be within a permissible range.

The parameter deriving unit 54 is configured to derive a determination parameter Z on the basis of the change-associated value X derived by the change-associated value deriving unit 53. In the present embodiment, the parameter deriving unit 54 derives, as the determination parameter Z, an integrated value of a predetermined number NTh of change-associated values X.

The leaking anomaly diagnostic unit 55 is configured to perform a leaking anomaly diagnostic process that diagnoses whether there is a leaking anomaly on the basis of the determination parameter Z derived by the parameter deriving unit 54. The leaking anomaly diagnostic process will be specifically described later.

Figure 4:
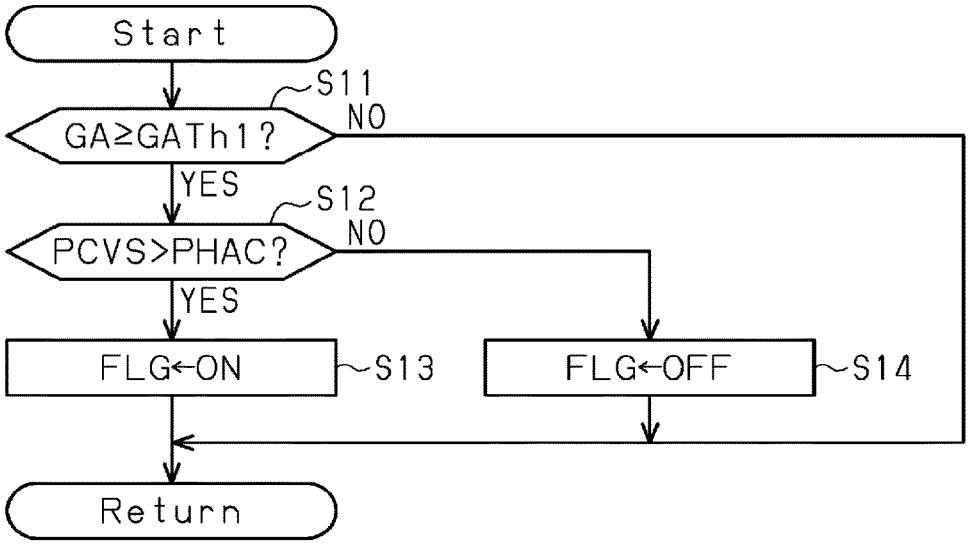
FIG. 4 is a flowchart showing a flow of processes for diagnosing whether there is a clogging anomaly.

A flow of the process of diagnosing whether there is a clogging anomaly will now be described with reference to FIG. 4. A series of processes shown in FIG. 4 is repeated during engine operation.

In the first step S11, the increase determination unit 51 determines whether the intake air amount GA is greater than or equal to a forced induction determining intake air amount GATh1. If there is a clogging anomaly, while the intake air amount GA is less than a first intake air amount GA1, the joint internal pressure PFIT correlated with the PCV pressure sensor value PCVS is substantially equal to the atmospheric pressure PHAC as shown in FIG. 3. That is, the clogging anomaly does not greatly affect the PCV pressure sensor value PCVS. Accordingly, the forced induction determining intake air amount GATh1 is set to an intake air amount that cannot be achieved when the forced-induction device 11 does not perform forced induction. Specifically, the forced induction determining intake air amount GATh1 is greater than the first intake air amount GA1.

If the intake air amount GA is less than the forced induction determining intake air amount GATh1 (S11: NO), the series of processes ends. That is, the process does not diagnose whether there is a clogging anomaly. In contrast, if the intake air amount GA is greater than or equal to the forced induction determining intake air amount GATh1 (S11: YES), the process proceeds to the next step S12. In step S12, the increase determination unit 51 determines whether the PCV pressure sensor value PCVS is greater than the atmospheric pressure PHAC. If the PCV pressure sensor value PCVS is greater than the atmospheric pressure PHAC, the joint internal pressure PFIT increases as the intake air amount GA increases. In contrast, if the PCV pressure sensor value PCVS is less than or equal to the atmospheric pressure PHAC, the joint internal pressure PFIT might not increase even when the intake air amount GA increases.

Accordingly, if the PCV pressure sensor value PCVS is greater than the atmospheric pressure PHAC (S12: YES), the process proceeds to the next step S13. In step S13, the clogging anomaly diagnostic unit 52 sets a clogging anomaly diagnostic flag FLG to ON. In other words, if the PCV pressure sensor value PCVS is greater than the atmospheric pressure PHAC, the joint internal pressure PFIT is determined to increase as the intake air amount GA increases under a situation where forced induction is performed by the forced-induction device 11. Thus, the process diagnoses that there is a clogging anomaly. Then, the series of processes ends.

In step S12, if the PCV pressure sensor value PCVS is less than or equal to the atmospheric pressure PHAC (NO), the process proceeds to next step S14. In step S14, the clogging anomaly diagnostic unit 52 sets the clogging anomaly diagnostic flag FLG to OFF. That is, the process does not diagnose that there is a clogging anomaly. Then, the series of processes ends.

Figure 5:
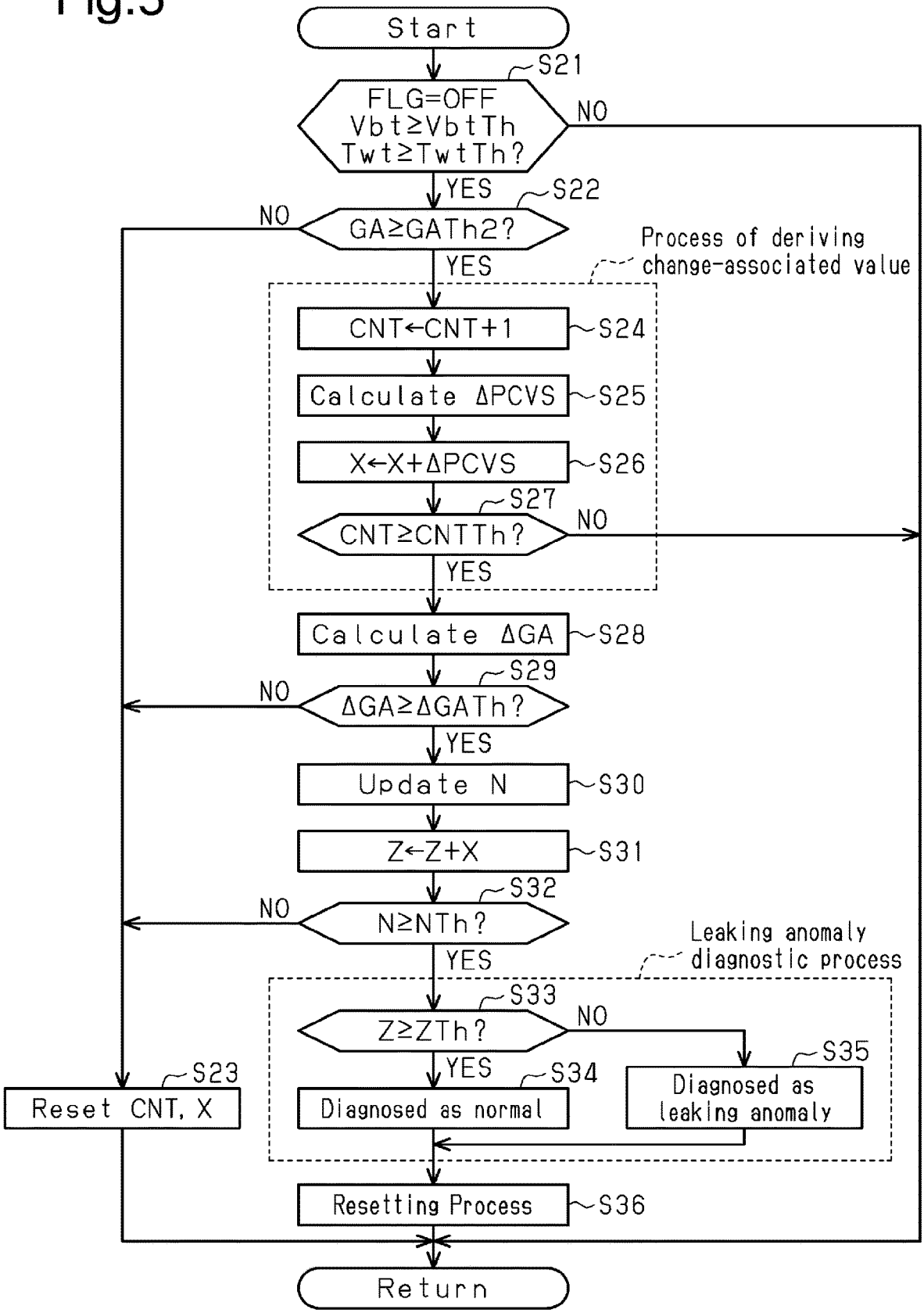
FIG. 5 is a flowchart showing a flow of processes for diagnosing whether there is a leaking anomaly.

A flow of the process of diagnosing whether there is a leaking anomaly will now be described with reference to FIG. 5. A series of processes shown in FIG. 5 is repeated during engine operation.

In the first step S21, the process determines whether a performance condition of the leaking anomaly diagnostic process is met. In the present embodiment, the process determines that the performance condition is met if all of the following are satisfied, including a condition in which the clogging anomaly diagnostic flag FLG is set to OFF, a condition in which the battery voltage Vbt is greater than or equal to a determination voltage VbtTh, and a condition in which a coolant temperature Twt is higher than or equal to a determination coolant temperature TwtTh. In contrast, the process does not determine that the performance condition is met if at least one of the following is not satisfied, including the condition in which the clogging anomaly diagnostic flag FLG is set to OFF, the condition in which the battery voltage Vbt is greater than or equal to the determination voltage VbtTh, and the condition in which the coolant temperature Twt is higher than or equal to the determination coolant temperature TwtTh. If the battery voltage Vbt is less than the determination voltage VbtTh, a sufficiently high voltage might not be applied to a sensor used for diagnosis. If the coolant temperature Twt is lower than the determination coolant temperature TwtTh, clogging resulting from freezing may occur in the blow-by gas passage 31.

If the process does not determine that the performance condition is met (S21: NO), the series of processes ends. That is, the process does not diagnose whether there is a leaking anomaly. If the process determines that the performance condition is met (S21: YES), the process proceeds to the next step S22. In step S22, the process determines whether the intake air amount GA is greater than or equal to a second determining intake air amount GATh2. The second determining intake air amount GATh2 is set to a value by which the PCV pressure sensor value PCVS differs between when there is a leaking anomaly and when the blow-by gas passage 31 is in the normal state.

If the intake air amount GA is less than the second determining intake air amount GATh2 (S22: NO), the process proceeds to the next step S23. In step S23, the process resets a measurement counter CNT described later and a change-associated value X to 0. Then, the series of processes ends. In step S22, if the intake air amount GA is greater than or equal to the second the determining intake air amount GATh2 (YES), the change-associated value deriving unit 53 performs the process of deriving the change-associated value X.

In the deriving process, in step S24, the measurement counter CNT is incremented by 1. The measurement counter CNT indicates the amount of time elapsed from when the deriving process started. In the next step S25, the process calculates a PCV pressure reduction amount ΔPCVS as the amount of reduction in the PCV pressure sensor value PCVS. Specifically, a reference value PCVSb is set to the PCV pressure sensor value PC VS at the starting point of the current monitoring period PRD. If the current PCV pressure sensor value PCVS is less than or equal to the reference value PCVSb, the difference between the current PCV pressure sensor value PCVS and the reference value PCVSb is calculated as the PCV pressure reduction amount ΔPCVS. If the current PCV pressure sensor value PCVS is greater than the reference value PCVSb, 0 is derived as the PCV pressure reduction amount ΔPCVS.

Subsequently in step S26, the sum of the current value of the change-associated value X and the PCV pressure reduction amount ΔPCVS is calculated as the latest value of the change-associated value X. Subsequently in step S27, the process determines whether the measurement counter CNT is greater than or equal to a determination counter CNTTh. The determination counter CNTTh serves as a criterion of whether the monitoring period PRD has ended. If the measurement counter CNT is less than the determination counter CNTTh (S27: NO), the monitoring period PRD has not ended, so that the series of processes ends. That is, the process of deriving the change-associated value X does not end. If the measurement counter CNT is greater than or equal to the determination counter CNTTh (S27: YES), the monitoring period PRD has ended, so that the process of deriving the change-associated value X ends. That is, the change-associated value X is equal to an integrated value of the PCV pressure reduction amount ΔPCVS in a single monitoring period PRD. The process proceeds to next step S28.

Figure 6:
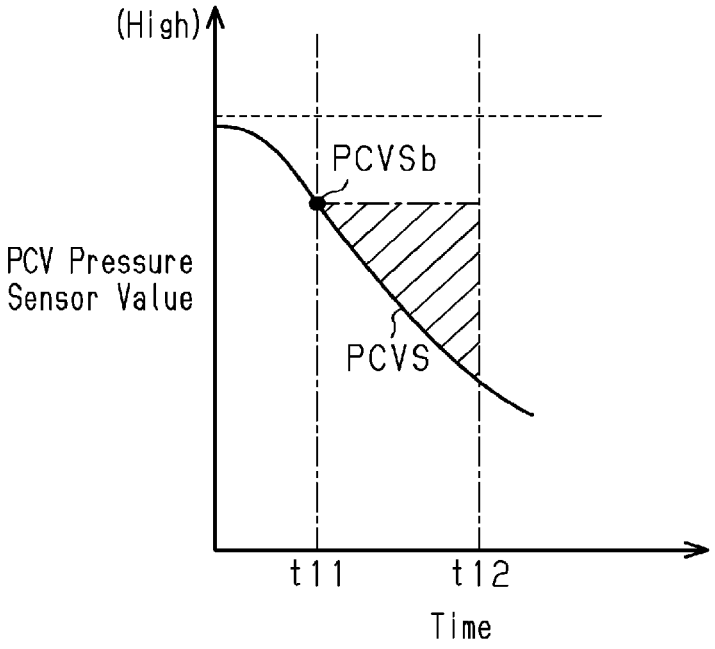
FIG. 6 is a timing diagram showing changes in a PCV pressure sensor value.

FIG. 6 illustrates an example of how a change-associated value X is calculated. In the example shown in FIG. 6, a single monitoring period PRD lasts from time t11 to time t12. Accordingly, a PCV pressure sensor value PCVS at time t11 is the reference value PCVSb. In the example shown in FIG. 6, the PCV pressure sensor value PCVS continues decreasing from time t11. The area of the hatched field in FIG. 6 corresponds to the change-associated value X. The change-associated value X is likely to increase as the amount of reduction in the PCV pressure sensor value PCVS increases in the monitoring period PRD.

Referring to FIG. 5, in step S28, the process calculates an amount of increase ΔGA in the intake air amount GA in the monitoring period PRD. Specifically, the process calculates the amount of increase ΔGA by subtracting the intake air amount GA at the starting point of the monitoring period PRD from the intake air amount GA at the end point of the monitoring period PRD. Accordingly, the amount of increase ΔGA is positive if the intake air amount GA increases in the monitoring period PRD. In the next step S29, the process determines whether the calculated amount of increase ΔGA is greater than or equal to an amount of increase for determination ΔGATh. The amount of increase for determination ΔGATh is set to a value corresponding to the intake air amount GA at the starting point of the monitoring period PRD. The amount of increase for determination ΔGATh is set, for example, from the map shown in FIG. 7.

Figure 7:
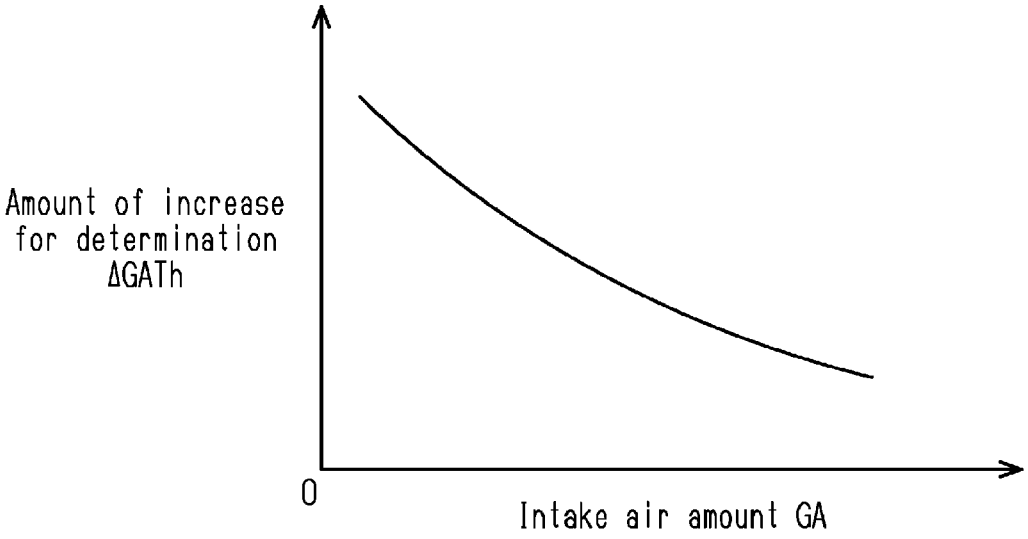
FIG. 7 is a map showing the relationship between an intake air amount and an amount of increase for determination.

The map shown in FIG. 7 indicates the relationship between the amount of increase for determination ΔGATh and the intake air amount GA at the starting point of the monitoring period PRD. As shown in FIG. 7, the amount of increase for determination ΔGATh is set to have a greater value when the intake air amount GA is smaller at the starting point of the monitoring period PRD.

As shown in FIG. 3, when the intake air amount GA is small at the starting point of the monitoring period PRD, the amount of change in the PCV pressure sensor value PCVS is less likely to differ between when the blow-by gas passage 31 is in the normal state and when there is a leaking anomaly while the amount of change in the intake air amount GA is smaller. Accordingly, the amount of increase for determination ΔGATh has a higher value when the intake air amount GA is smaller at the starting point of the monitoring period PRD.

Referring to FIG. 5, in step S29, if the amount of increase ΔGA is less than the amount of increase for determination ΔGATh (NO), the process proceeds to step S23 described above. If the amount of increase ΔGA is greater than or equal to the amount of increase for determination ΔGATh (YES), the process proceeds to next step S30. In step S30, the parameter deriving unit 54 increments the number of times of integration N by 1. Subsequently in step S31, the parameter deriving unit 54 calculates the sum of the determination parameter Z and the change-associated value X as the latest value of the determination parameter Z.

In the next step S32, the process determines whether the number of times of integration N is greater than or equal to a predetermined number NTh. If the number of times of integration N is less than the predetermined number NTh (S32: NO), the calculation of the determination parameter Z is not completed, so that the process proceeds to step S23 described above. If the number of times of integration N is greater than or equal to the predetermined number NTh (S32: YES), the calculation of the determination parameter Z is completed, so that the leaking anomaly diagnostic unit 55 performs the leaking anomaly diagnostic process. In other words, the process calculates, as a determination parameter Z, an integrated value of change-associated values X derived in accordance with the amount of change in the PCV pressure sensor value PCVS in the monitoring period PRD where the amount of increase ΔGA is greater than or equal to the amount of increase for determination ΔGATh.

In the leaking anomaly diagnostic process, in step S33, the process determines whether the determination parameter Z is greater than or equal to a parameter threshold ZTh. The parameter threshold ZTh is set as a criterion of whether the blow-by gas passage 31 is in the normal state on the basis of the determination parameter Z. If the determination parameter Z is greater than or equal to a parameter threshold ZTh, (S33: YES), the determination parameter Z is determined as large, so that the process proceeds to the next step S34. In step S34, the process diagnoses that the blow-by gas passage 31 is in the normal state. The leaking anomaly diagnostic process ends and the process proceeds to step S36.

In step S33, if the determination parameter Z is less than the parameter threshold ZTh (NO), the determination parameter Z is not determined as large, so that the process proceeds to the next step S35. In step S35, the process diagnoses that there is a leaking anomaly at the blow-by gas passage 31. The leaking anomaly diagnostic process ends and the process proceeds to step S36.

In step S36, a resetting process is performed. In the resetting process, the measurement counter CNT, the change-associated value X, the number of times of integration N, and the determination parameter Z are reset to 0. Then, the series of processes ends.

Figure 8:
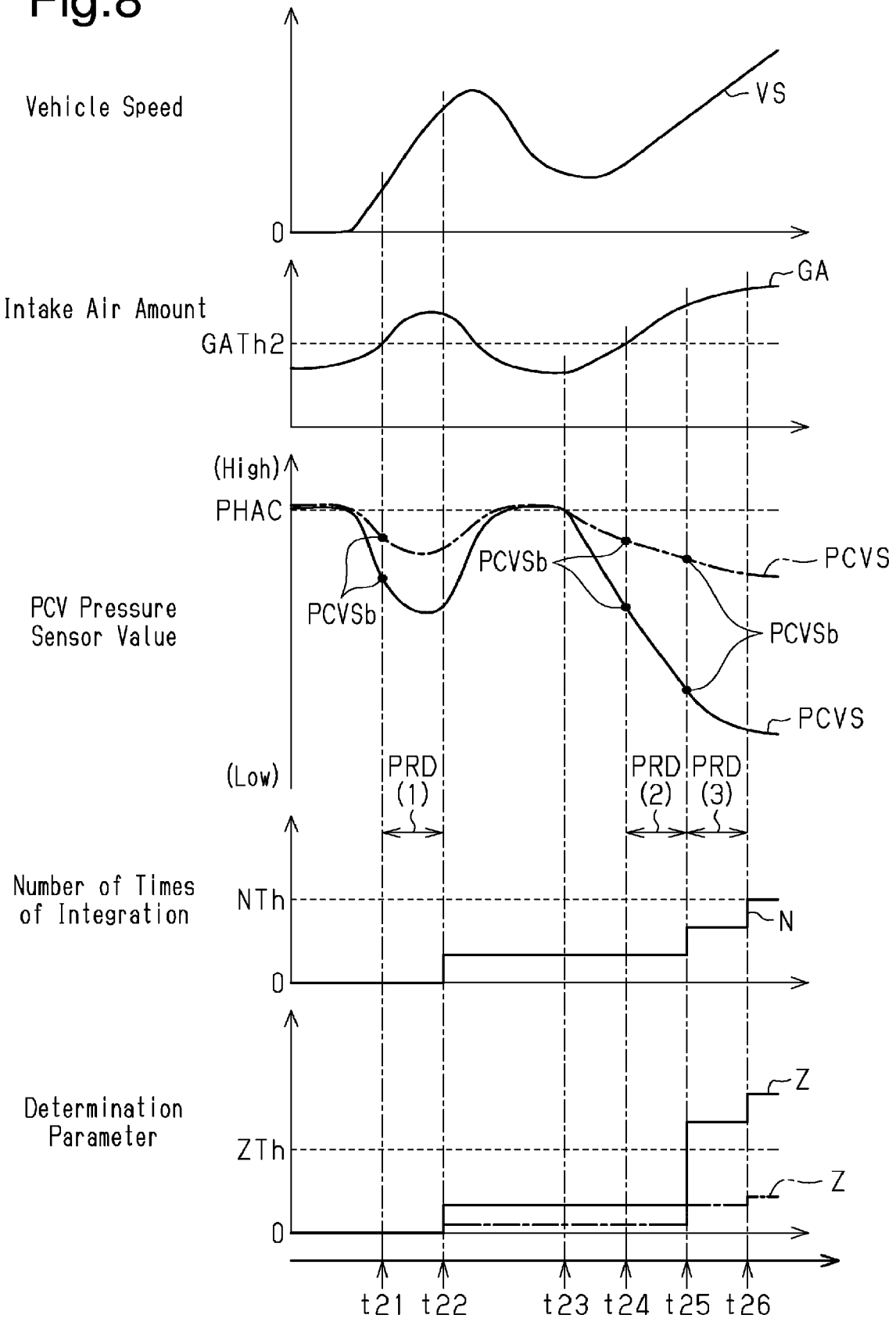
FIG. 8 is a timing diagram when diagnosing whether there is a leaking anomaly when the vehicle is traveling.

With reference to FIG. 8, the operation and advantages of the present embodiment will now be described. In the timing diagram of FIG. 8 showing changes in the PCV pressure sensor value PCVS, the solid line shows the changes in the PCV pressure sensor value PCVS when the blow-by gas passage 31 is in the normal state, and the long dashed short dashed line shows the changes in the PCV pressure sensor value PCVS when there is a leaking anomaly. In the timing diagram of FIG. 8 showing changes in the determination parameter Z, the solid line shows the changes in the determination parameter Z when the blow-by gas passage 31 is in the normal state, and the long dashed short dashed line shows the changes in determination parameter Z when there is a leaking anomaly.

When the vehicle is traveling, intake air is pressurized through driving of the forced-induction device 11 in the internal combustion engine 10. At time t21, the intake air amount GA is greater than or equal to the second determining intake air amount GATh2, so that the process of deriving the change-associated value X starts. The deriving process ends at time t22. The amount of increase ΔGA in an intake air amount from time t21 to time t22 is greater than or equal to the amount of increase for determination ΔGATh. The period from time t21 to time t22 is referred to as a monitoring period PRD (1). The determination parameter Z is updated by a change-associated value X(1) that is derived in accordance with a change in the PCV pressure sensor value PCVS in the monitoring period PRD (1).

When the intake air amount GA increases in the monitoring period PRD (1), a negative pressure is generated in the upstream intake passage 241. If the blow-by gas passage 31 is in the normal state, blow-by gas in the blow-by gas passage 31 flows into the intake passage 24. This reduces the PCV pressure sensor value PC VS. If there is a leaking anomaly, the space inside the blow-by gas passage 31 is connected to the atmosphere. Accordingly, even if a negative pressure is generated in the upstream intake passage 241, the PCV pressure sensor value PCVS is less likely to decrease than when the blow-by gas passage 31 is in the normal state. Accordingly, if there is a leaking anomaly, the change-associated value X(1) is less likely to increase than when the blow-by gas passage 31 is in the normal state.

From time t22, the intake air amount GA decreases, namely, the pressure of forced induction decreases. Thus, even if the process of deriving the change-associated value X is performed, the determination parameter Z is not updated by a change-associated value X derived at this time. When the intake air amount GA decreases, a negative pressure generated in the upstream intake passage 241 becomes smaller, so that the PCV pressure sensor value PC VS is closer to the atmospheric pressure PHAC from time t22.

From time t23, the intake air amount GA increases again through driving of the forced-induction device 11. At time t24, the intake air amount GA is greater than or equal to the second determining intake air amount GATh2, so that the process of deriving the change-associated value X starts. The deriving process ends at time t25. The amount of increase ΔGA in an intake air amount from time t24 to time t25 is greater than or equal to the amount of increase for determination ΔGATh. The period from time t24 to time t25 is referred to as a monitoring period PRD (2). The determination parameter Z is updated by a change-associated value X(2) that is derived in accordance with a change in the PCV pressure sensor value PCVS in the monitoring period PRD (2).

In the example shown in FIG. 8, the intake air amount GA is greater than the second determining intake air amount GATh2 at time t25, at which the monitoring period PRD (2) ends. The intake air amount GA further increases from time t25. Accordingly, the process of deriving the change-associated value X starts from time t25. The deriving process ends at time t26. The amount of increase ΔGA in an intake air amount from time t25 to time t26 is greater than or equal to the amount of increase for determination ΔGATh. The period from time t25 to time t26 is referred to as a monitoring period PRD (3). The determination parameter Z is updated by a change-associated value X(3) that is derived in accordance with a change in the PCV pressure sensor value PCVS in the monitoring period PRD (3).

In the example shown in FIG. 8, the number of times of integration N reaches the predetermined number NTh at time t26. Accordingly, the leaking anomaly diagnostic process is performed at time t26. As shown by the solid line of the timing diagram that shows the change in the determination parameter Z, when the determination parameter Z is greater than or equal to the parameter threshold ZTh, the process diagnoses that the blow-by gas passage 31 is in the normal state because the PCV pressure sensor value PCVS decreases as the pressure in the upstream intake passage 241 decreases through driving of the forced-induction device 11.

In contrast, as shown by the long dashed short dashed line of the timing diagram that shows the change in the determination parameter Z, when the determination parameter Z is less than the parameter threshold ZTh, the process diagnoses that there is a leaking anomaly because the PCV pressure sensor value PCVS does not greatly decrease when the pressure in the upstream intake passage 241 decreases through driving of the forced-induction device 11.

In the present embodiment, the determination parameter Z is used to detect that the blow-by gas pipe 33 is broken, the blow-by gas pipe 33 has been disconnected from the intake passage 24, and the blow-by gas pipe 33 has been disconnected from the joint 32.

The present embodiment also has the following advantages.

(1-1) In the present embodiment, a value corresponding to the amount of reduction in the PCV pressure sensor value PCVS in a monitoring period PRD is derived as the change-associated value X, and then an integrated value of plural change-associated values X is calculated as the determination parameter Z. The length of the monitoring period PRD is set in consideration of the temperature characteristics of the PCV pressure sensor 35 and a change in the atmospheric pressure PHAC when the vehicle is traveling.

The amount of change in temperature of the PCV pressure sensor 35 in the monitoring period PRD is less likely to increase as the monitoring period PRD becomes shorter. Accordingly, the monitoring period PRD is made short so that the temperature characteristics of the PCV pressure sensor 35 are less likely to affect the change-associated value X.

The PCV pressure sensor 35 detects an absolute pressure. If the space inside the blow-by gas passage 31 is connected to the atmosphere, the atmospheric pressure PHAC changes while the vehicle is traveling on a slope, so that the PCV pressure sensor value PCVS changes in accordance with the change in the atmospheric pressure PHAC. Accordingly, if the amount of change in the atmospheric pressure PHAC is great in a single monitoring period PRD, the amount of change resulting from a change in the atmospheric pressure PHAC greatly accounts for the amount of change in the PCV pressure sensor value PCVS. In other words, the change in the atmospheric pressure PHAC is likely to affect the change-associated value X. In this respect, in the present embodiment, the length of the monitoring period PRD is set in consideration of the change in the atmospheric pressure PHAC when the vehicle is traveling. Thus, even if the inside of the blow-by gas passage 31 is connected to the atmosphere, the change in the atmospheric pressure PHAC is less likely to affect the change-associated value X.

The determination parameter Z is calculated by integrating plural change-associated values X that are not greatly affected by the temperature characteristics of the PCV pressure sensor 35 or the change in the atmospheric pressure PHAC. Thus, the determination parameter Z is calculated to be a value that is not greatly affected by the temperature characteristics of the PCV pressure sensor 35 or the change in the atmospheric pressure PHAC when the vehicle is traveling. Such a determination parameter Z is used to perform the leaking anomaly diagnostic process so that a decline in the accuracy of diagnose will be restricted.

(1-2) In the present embodiment, an integrated value of the amount of reduction in the PCV pressure sensor value PCVS from the reference value PCVSb in the monitoring period PRD is calculated to be the change-associated value X. Accordingly, the difference in the change-associated value X increases between when the blow-by gas passage 31 is in the normal state and when there is a leaking anomaly.

(1-3) In the present embodiment, the clogging anomaly diagnostic process is also performed. In the clogging anomaly diagnostic process, if the pressure in the blow-by gas passage 31 is determined to be greater than the atmospheric pressure PHAC during forced induction, the process diagnoses that there is a clogging anomaly. In other words, the present embodiment detects that there is a clogging anomaly.

(1-4) When there is a clogging anomaly, the determination parameter Z is calculated and used to perform the leaking anomaly diagnostic process. In this case, the determination parameter Z is less than the parameter threshold ZTh so that the process may diagnose that there is a leaking anomaly. In this respect, in the present embodiment, if the process diagnoses that there is a clogging anomaly, the leaking anomaly diagnostic process is not performed. This reduces erroneous diagnosis of a leaking anomaly when there is a clogging anomaly.

Second Embodiment

An anomaly diagnostic device 50 for an onboard internal combustion engine according to a second embodiment will now be described with reference to FIGS. 9 to 11. The second embodiment differs from the first embodiment in calculation of the change-associated value X. Accordingly, the difference will mainly be described hereafter, and like or same reference numerals are given to those components that are the same as the corresponding components of the first embodiment. Such components will not be described.

Figure 9:
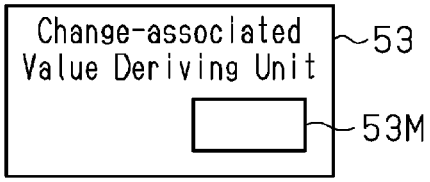
FIG. 9 is a block diagram showing the functional configuration of a change-associated value deriving unit in an anomaly diagnostic device according to a second embodiment.
Figure 10:
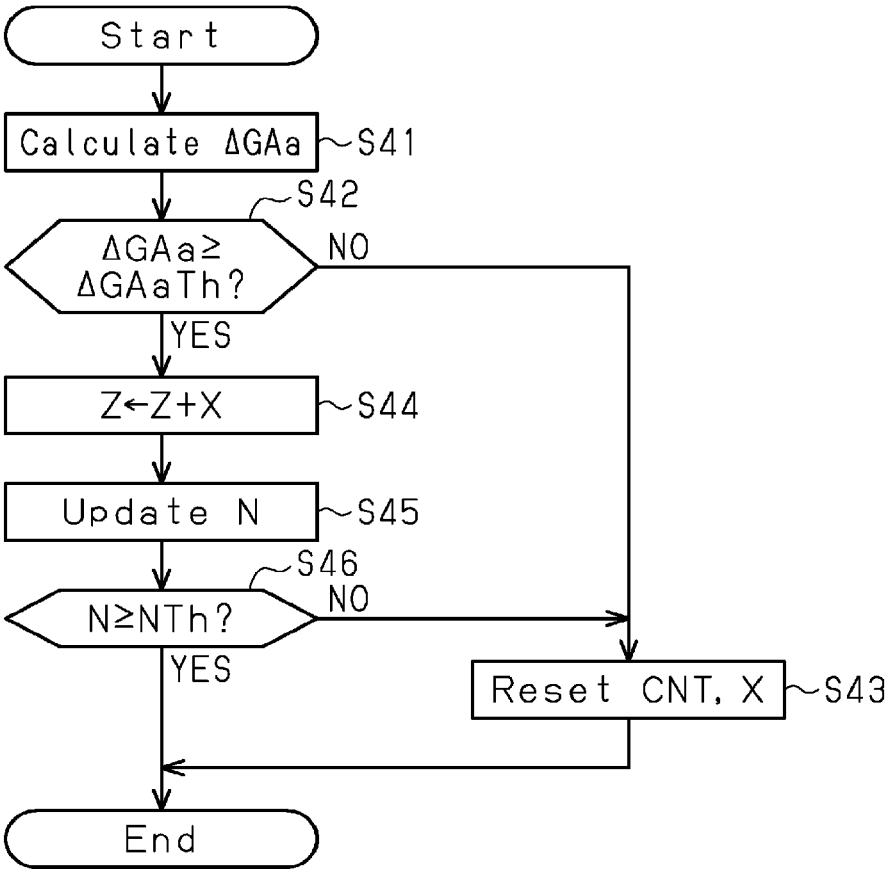
FIG. 10 is a flowchart showing a flow of processes when the anomaly diagnostic device according to the second embodiment derives a determination parameter.

As shown in FIG. 9, the change-associated value deriving unit 53 includes a sensor value storage 53M that sequentially stores a PCV pressure sensor value PCVS in a monitoring period PRD. The sensor value storage 53M stores a PCV pressure sensor value PCVS each time the measurement counter CNT is updated in the monitoring period PRD. That is, the change-associated value deriving unit 53 obtains PCV plural pressure sensor values PCVS in a single monitoring period PRD.

In the present embodiment, the change-associated value deriving unit 53 performs the process of deriving the change-associated value X when the intake air amount GA increases in the same manner as the first embodiment. In this case, the change-associated value deriving unit 53 stores a PCV pressure sensor value PCVS in the sensor value storage 53M each time the measurement counter CNT is updated. When the measurement counter CNT is greater than or equal to the determination counter CNTTh, the change-associated value deriving unit 53 ends the process of storing the PCV pressure sensor value PCVS in the sensor value storage 53M. The change-associated value deriving unit 53 sets the reference value PCVSb to the maximum value among plural pressure sensor values PCVS stored in the sensor value storage 53M. Then, the change-associated value deriving unit 53 calculates the difference between the reference value PCVSb and the plural pressure sensor values PCVS stored in the sensor value storage 53M and calculates an integrated value of plural differences as a change-associated value X. When the calculation of the change-associated value X is completed, the change-associated value deriving unit 53 deletes the plural pressure sensor values PCVS from the sensor value storage 53M and ends the deriving process.

Figure 11:
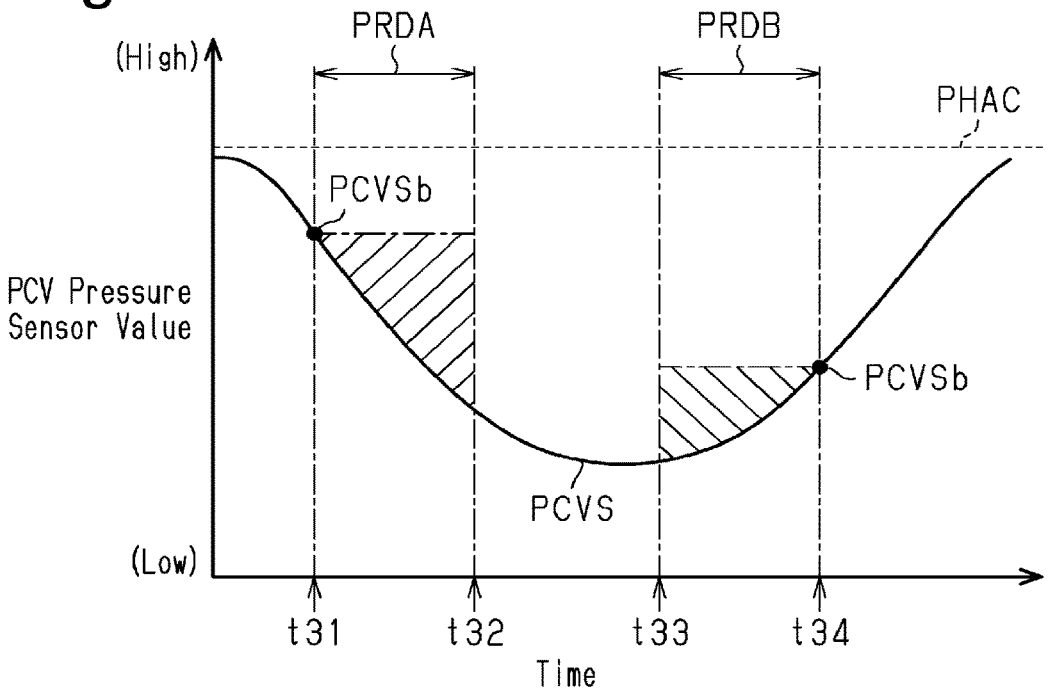
FIG. 11 is a timing diagram showing changes in a PCV pressure sensor value.

In FIG. 11, the period from time t31 to time t32 is a monitoring period PRDA where the intake air amount GA increases. When the intake air amount GA increases as in the monitoring period PRDA, the PCV pressure sensor value PCVS decreases as the intake air amount GA increases. Accordingly, in the example shown in FIG. 11, the reference value PCVSb is set to the PCV pressure sensor value PCVS at time t31, which is the starting point of the monitoring period PRDA. In this case, the area of the hatched field in FIG. 11 corresponds to the change-associated value X in the monitoring period PRDA.

In the present embodiment, the change-associated value deriving unit 53 performs the process of deriving the change-associated value X even when the intake air amount GA decreases. In this case, the change-associated value deriving unit 53 stores a PCV pressure sensor value PCVS in the sensor value storage 53M each time the measurement counter CNT is updated. When the measurement counter CNT is greater than or equal to the determination counter CNTTh, the change-associated value deriving unit 53 ends the process of storing the PCV pressure sensor value PCVS in the sensor value storage 53M. The change-associated value deriving unit 53 sets the reference value PCVSb to the maximum value among plural pressure sensor values PCVS stored in the sensor value storage 53M. Then, the change-associated value deriving unit 53 calculates the difference between the reference value PCVSb and the plural pressure sensor values PCVS stored in the sensor value storage 53M and calculates an integrated value of plural differences as a change-associated value X. When the calculation of the change-associated value X is completed, the change-associated value deriving unit 53 deletes the plural pressure sensor values PCVS from the sensor value storage 53M and ends the deriving process.

In FIG. 11, the period from time t33 to time t34 is a monitoring period PRDB where the intake air amount GA decreases. When the intake air amount GA decreases as in the monitoring period PRDB, the PCV pressure sensor value PCVS increases as the intake air amount GA decreases. Accordingly, in the example shown in FIG. 11, the reference value PCVSb is set to the PCV pressure sensor value PCVS at time t34, which is the end point of the monitoring period PRDB. In this case, the area of the hatched field in FIG. 11 corresponds to the change-associated value X in the monitoring period PRDB.

A flow of processes from when calculation of the change-associated value X is completed to when the determination parameter Z is calculated will be described with reference to FIG. 10. A series of processes shown in FIG. 10 starts when the change-associated value deriving unit 53 ends the process of deriving the change-associated value X.

In the first step S41, the process calculates an amount of change ΔGAa in the intake air amount GA in the monitoring period PRD when the change-associated value X is calculated. The difference between the intake air amount GA at the starting point of the monitoring period PRD and the maximum value among the intake air amount GA in the monitoring period PRD is referred to as the first difference. The difference between the intake air amount GA at the starting point of the monitoring period PRD and the minimum value of the intake air amount GA in the monitoring period PRD is referred to as the second difference. The greater one of the first difference and the second difference is calculated to be the amount of change ΔGAa.

Subsequently in step S42, the process determines whether the amount of change ΔGAa is greater than or equal to an amount of change for determination ΔGAaTh. The amount of change for determination ΔGAaTh is set to have a greater value when the intake air amount GA is smaller at the starting point of the monitoring period PRD in the same manner as the amount of increase for determination ΔGATh used in the first embodiment.

If the amount of change ΔGAa is less than the amount of change for determination ΔGAaTh (S42: NO), the process proceeds to the next step S43. In step S43, the process resets the measurement counter CNT and the change-associated value X to 0. Then, the series of processes ends. In step S42, if the amount of change ΔGAa is greater than or equal to the amount of change for determination ΔGAaTh (YES), the process proceeds to the next step S44. In step S44, the parameter deriving unit 54 calculates the sum of the determination parameter Z and the change-associated value X as the latest value of the determination parameter Z.

Subsequently in step S45, the parameter deriving unit 54 increments the number of times of integration N by 1. In step S46, the process determines whether the number of times of integration N is greater than or equal to a predetermined number NTh. If the number of times of integration N is less than the predetermined number NTh (S46: NO), the calculation of the determination parameter Z is not completed, so that the process proceeds to step S43 described above. If the number of times of integration N is greater than or equal to the predetermined number NTh (S46: YES), the calculation of the determination parameter Z is completed, so that the series of processes ends. That is, a value obtained by integrating plural change-associated values X is calculated as the determination parameter Z. Then, the determination parameter Z is used to perform the leaking anomaly diagnostic process.

The present embodiment has the following advantages.

(2-1) In the present embodiment, the determination parameter Z is calculated using the change-associated value X that is calculated when the intake air amount GA increases and the change-associated value X that is calculated when the intake air amount GA decreases. This increases opportunities to calculate the change-associated value X than when the determination parameter Z is derived using only the change-associated value X that is calculated when the intake air amount GA increases as in the first embodiment. The increased opportunities to calculate the change-associated value X shorten the period of time required to complete deriving of the determination parameter Z. This allows the leaking anomaly diagnostic process to be started earlier.

Third Embodiment

Figure 12:
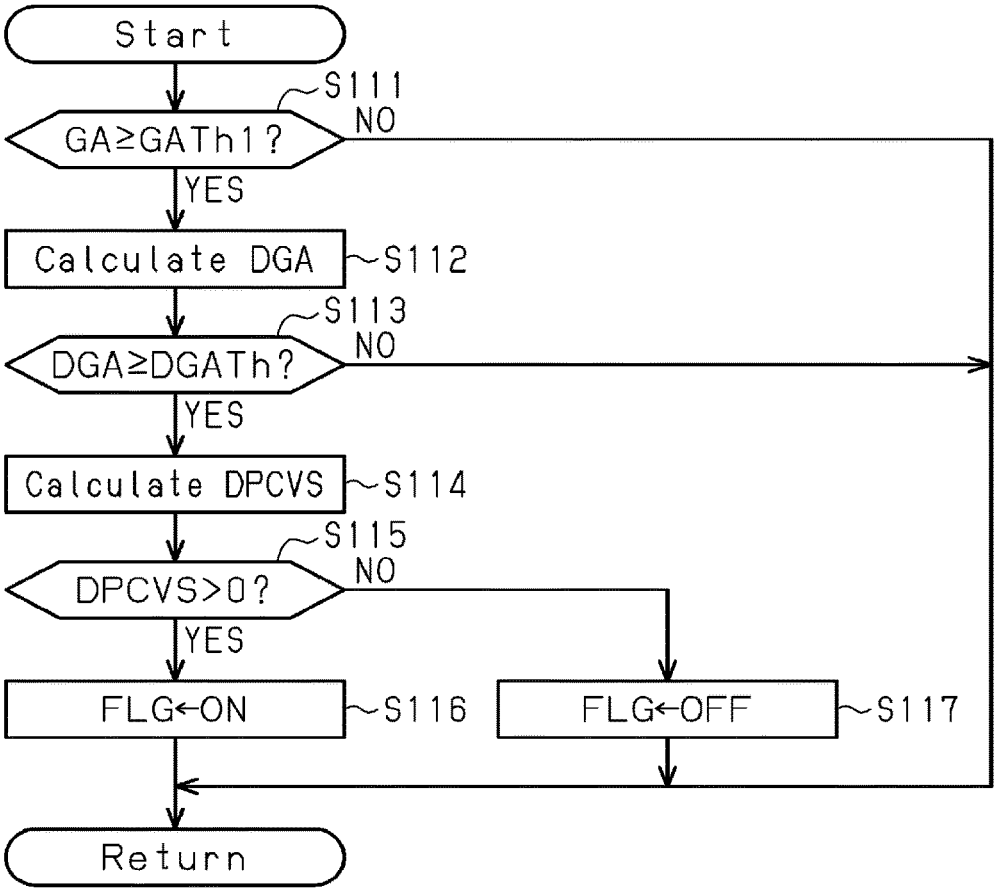
FIG. 12 is a flowchart showing a flow of processes when an anomaly diagnostic device according to a third embodiment diagnoses whether there is a clogging anomaly.

An anomaly diagnostic device 50 for an onboard internal combustion engine according to a third embodiment will now be described with reference to FIG. 12. The third embodiment differs from the above embodiments in steps of the clogging anomaly diagnostic process. Accordingly, the difference will mainly be described hereafter, and like or same reference numerals are given to those components that are the same as the corresponding components of the above embodiments. Such components will not be described.

A flow of the process of diagnosing whether there is a clogging anomaly will now be described with reference to FIG. 12. A series of processes shown in FIG. 12 is repeated during engine operation.

In the first step S111, the increase determination unit 51 determines whether the intake air amount GA is greater than or equal to the forced induction determining intake air amount GATh1. If the intake air amount GA is less than the forced induction determining intake air amount GATh1 (S111: NO), the series of processes ends. That is, the process does not diagnose whether there is a clogging anomaly. If the intake air amount GA is greater than or equal to the forced induction determining intake air amount GATh1 (S111: YES), the process proceeds to the next step S112. In step S112, the increase determination unit 51 calculates a rate of increase DGA in the intake air amount GA. The increase determination unit 51 can calculate the rate of increase DGA by, for example, calculating the time derivative of the intake air amount GA. The value of the rate of increase DGA is positive when the intake air amount GA increases.

In step S113, the increase determination unit 51 determines whether the rate of increase DGA is greater than or equal to a rate of increase for determination DGATh. If the rate of increase DGA is less than the rate of increase for determination DGATh (S113: NO), the intake air amount GA has not increased or the intake air amount GA has increased but the amount of increase is insufficient, so that the series of processes ends. If the rate of increase DGA is greater than or equal to the rate of increase for determination DGATh (S113: YES), the process proceeds to the next step S114.

In step S114, the increase determination unit 51 calculates a rate of increase DPCVS in the PCV pressure sensor value PCVS. The increase determination unit 51 calculates the rate of increase DPCVS by, for example, calculating the time derivative of the PCV pressure sensor value PCVS. The value of the rate of increase DPCVS is positive when the PCV pressure sensor value PCVS increases. In the next step S115, the increase determination unit 51 determines whether the rate of increase DPCVS is greater than 0.

If there is a clogging anomaly, when the intake air amount GA is greater than or equal to a certain amount, the PCV pressure sensor value PCVS increases as the intake air amount GA increases as shown in FIG. 3.

Accordingly, in step S115, if the rate of increase DPCVS is greater than 0 (YES), the increase determination unit 51 can determine that the PCV pressure sensor value PCVS will increase when the intake air amount GA increases. Accordingly, the process proceeds to the next step S116. In step S116, the clogging anomaly diagnostic unit 52 sets a clogging anomaly diagnostic flag FLG to ON. That is, the process diagnoses that there is a clogging anomaly. Then, the series of processes ends.

In step S115, if the rate of increase DPCVS is less than or equal to 0 (NO), the process proceeds to the next step S117. In step S117, the clogging anomaly diagnostic unit 52 sets the clogging anomaly diagnostic flag FLG to OFF. That is, if the value of the rate of increase DPCVS is not positive, the process does not diagnose that there is a clogging anomaly. Then, the series of processes ends.

Modifications

The above-described embodiments may be modified as follows. The above-described embodiments and the following modifications can be combined as long as the combined modifications remain technically consistent with each other.

The PCV pressure sensor 35 may be connected to the blow-by gas pipe 33. In this case, if a portion of the blow-by gas pipe 33 that is closer to the intake passage 24 than to the connection portion of the PCV pressure sensor 35 has been broken or if the blow-by gas pipe 33 has been disconnected from the intake passage 24, the process diagnoses that there is a leaking anomaly.

Clogging in the blow-by gas pipe 33 may be caused by freezing in the blow-by gas pipe 33. Specifically, if the coolant temperature Twt is low, a clogging anomaly resulting from freezing may occur. If the coolant temperature Twt is high, a clogging anomaly resulting from freezing does not occur. In the series of processes shown in FIG. 5, the performance condition of the leaking anomaly diagnostic process includes that the coolant temperature Twt is higher than or equal to the determination coolant temperature TwtTh. If the determination coolant temperature TwtTh is set to a value that allows for determination that freezing has not occurred, the performance condition of the leaking anomaly diagnostic process does not have to include setting of the clogging anomaly diagnostic flag FLG to OFF. That is, the clogging anomaly diagnostic process is not necessarily performed.

A value differing from the value described in the above embodiments may be calculated as a change-associated value as long as a value corresponding to the amount of change in the PCV pressure sensor value PCVS in a monitoring period PRD is derived as the change-associated value. A path length that indicates the length of a line of change in the PCV pressure sensor value PCVS in the monitoring period PRD may be derived as a change-associated value.

Calculation of the change-associated value X may be repeatedly performed until the amount of time elapsed from when the performance condition of the leaking anomaly diagnostic process was met achieves the amount of elapsed time for determination and the total sum of all the change-associated values X may be calculated to be the determination parameter Z. In this case, the parameter threshold ZTh is changed in accordance with the number of times of integration N of the change-associated values X when the determination parameter Z is calculated. The parameter threshold ZTh is set to a larger value as the number of times of integration N increases.

The average value of plural change-associated values X may be derived as a determination parameter. The determination parameter may be used to diagnose whether there is a leaking anomaly.

In the first embodiment, the amount of increase for determination ΔGATh may be fixed.

In the second embodiment, the amount of change for determination ΔGAaTh may be fixed.

The PCV pressure sensor 35 may be a sensor that detects a gauge pressure, which is a relative pressure based on the atmospheric pressure PHAC.

The amount of reduction in the PCV pressure sensor value PCVS in a period that is longer than the monitoring period PRD described in the above embodiments may be derived as the determination parameter. This can still diagnose whether there is a leaking anomaly while the accuracy of diagnosis is lower than the above embodiments.

The blow-by gas passage may be a passage that includes one end that is connected to the crankcase 13 and another end that is connected to the upstream intake passage 241. In this case, the space inside the crankcase 13 corresponds to the storage portion.

The internal combustion engine may include an engine-driven forced-induction device.

The diagnostic device 50 is not limited to a device that includes a CPU and a memory and executes software processing. For example, at least part of the processes executed by the software in the above-described embodiment may be executed by hardware circuits dedicated to execution of these processes (such as ASIC). That is, the diagnostic device 50 may be modified to have any one of the following configurations (a) to (c). (a) A configuration including a processor that executes all of the above-described processes according to programs and a program storage device such as a ROM that stores the programs. (b) A configuration including a processor and a program storage device that execute part of the above-described processes according to the programs and a dedicated hardware circuit that executes the remaining processes. (c) A configuration including a dedicated hardware circuit that executes all of the above-described processes. A plurality of software processing circuits each including a processor and a program storage device and a plurality of dedicated hardware circuits may be provided. That is, the above processes may be executed in any manner as long as the processes are executed by processing circuitry that includes at least one of a set of one or more software processing circuits and a set of one or more dedicated hardware circuits.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. An anomaly diagnostic device for an onboard internal combustion engine, the anomaly diagnostic device being configured to diagnose the onboard internal combustion engine, wherein the onboard internal combustion engine includes:

a forced-induction device, a storage portion that stores blow-by gas leaked into a crankcase from a combustion chamber, a blow-by gas passage that connects the storage portion and a portion of an intake passage that is upstream of a compressor of the forced-induction device, and a PCV pressure sensor that is connected to the blow-by gas passage and detects a pressure in the blow-by gas passage, the anomaly diagnostic device comprising:

a parameter deriving unit configured to derive a determination parameter such that, when a PCV pressure sensor value that indicates a pressure detected by the PCV pressure sensor is less than an atmospheric pressure, a value of the determination parameter increases as a difference between the PCV pressure sensor value and the atmospheric pressure increases; and a leaking anomaly diagnostic unit configured to perform a leaking anomaly diagnostic process that diagnoses that there is an anomaly at a portion of the blow-by gas passage that is closer to the intake passage than to a connection portion of the PCV pressure sensor in a case in which the determination parameter derived when an intake air amount changes, is less than a threshold.

2. The anomaly diagnostic device for an onboard internal combustion engine according to claim 1, further comprising a change-associated value deriving unit that is configured to derive a change-associated value corresponding to an amount of change in the PCV pressure sensor value in a predetermined monitoring period, wherein the parameter deriving unit is configured to derive an integrated value of a plurality of change-associated values as the determination parameter.

3. The anomaly diagnostic device for an onboard internal combustion engine according to claim 2, wherein the change-associated value deriving unit is configured to set a reference value to the PCV pressure sensor value at a starting point of the monitoring period when the intake air amount is increasing, and the change-associated value deriving unit is also configured to derive an integrated value of differences between a plurality of PCV pressure sensor values and the reference value in the monitoring period as the change-associated value, and the parameter deriving unit is configured to derive the determination parameter by integrating the change-associated values derived based on a change in the PCV pressure sensor value in the monitoring period when an amount of increase in the intake air amount in the monitoring period is greater than or equal to an amount of change for determination.

4. The anomaly diagnostic device for an onboard internal combustion engine according to claim 2, wherein the change-associated value deriving unit is configured to obtain a plurality of PCV pressure sensor values in the monitoring period when the intake air amount increases or decreases, set a reference value to a maximum value among the plurality of PCV pressure sensor values obtained in the monitoring period, and derive, as the change-associated value, an integrated value of differences between the plurality of PCV pressure sensor values obtained in the monitoring period and the reference value.

5. The anomaly diagnostic device for an onboard internal combustion engine according to claim 1, further comprising:

an increase determination unit that is configured to determine, based on the PCV pressure sensor value, whether the pressure in the blow-by gas passage will increase when the intake air amount is increased; and a clogging anomaly diagnostic unit that is configured to diagnose that there is clogging in a portion of the blow-by gas passage that is located closer to the intake passage than to the connection portion when the increase determination unit determines that the pressure in the blow-by gas passage will increase when the intake air amount is increased under a situation where intake air is changed, wherein the leaking anomaly diagnostic unit is configured to perform the leaking anomaly diagnostic process on condition that the clogging anomaly diagnostic unit has not diagnosed that there is clogging in the portion of the blow-by gas passage that is located closer to the intake passage than to the connection portion.

6. The anomaly diagnostic device for an onboard internal combustion engine according to claim 1, wherein the blow-by gas passage includes a joint connected to the storage portion and a blow-by gas pipe that includes an end connected to the joint and another end connected to the intake passage, and the PCV pressure sensor is connected to the joint.

7. An anomaly diagnostic device for an onboard internal combustion engine, the anomaly diagnostic device being configured to diagnose the onboard internal combustion engine, wherein the onboard internal combustion engine includes a forced-induction device, a storage portion that stores blow-by gas leaked into a crankcase from a combustion chamber, a blow-by gas passage that connects the storage portion and a portion of an intake passage that is upstream of a compressor of the forced-induction device, and a PCV pressure sensor that is connected to the blow-by gas passage and detects a pressure in the blow-by gas passage, the anomaly diagnostic device comprising:

processing circuitry configured to:

derive a determination parameter such that, when a PCV pressure sensor value that indicates a pressure detected by the PCV pressure sensor is less than an atmospheric pressure, a value of the determination parameter increases as a difference between the PCV pressure sensor value and the atmospheric pressure increases; and perform a leaking anomaly diagnostic process that diagnoses that there is an anomaly at a portion of the blow-by gas passage that is closer to the intake passage than to a connection portion of the PCV pressure sensor in a case in which the determination parameter derived when an intake air amount changes is less than a threshold.

* * * * *